United States Patent [19]

Watson et al.

[11] 4,304,057

[45] Dec. 8, 1981

[54] SNOW PLOW ASSEMBLY INCLUDING LINEAR ACTUATOR

[75] Inventors: Gary E. Watson, Mequon; Edward A. Simi, Menomonee Falls, both of Wis.

[73] Assignee: Douglas Dynamics Inc., Milwaukee, Wis.

[21] Appl. No.: 163,563

[22] Filed: Jun. 27, 1980

[51] Int. Cl.[3] ..... E01H 5/00

[52] U.S. Cl. ..... 37/42 R; 74/414; 172/828

[58] Field of Search ..... 37/41, 42 R, 42 VL, 37/50, 117.5; 172/816, 817, 828, 820, 811; 74/414

[56] References Cited

U.S. PATENT DOCUMENTS

| | | | |
|---|---|---|---|
| 3,142,197 | 7/1964 | Le Tourneau | 37/41 X |
| 3,161,072 | 12/1964 | Le Tourneau | 37/41 X |
| 3,307,275 | 3/1967 | Simi | 37/42 R |
| 3,605,906 | 9/1971 | Coates | 37/42 R |
| 3,828,449 | 8/1974 | Miceli | 37/41 |
| 4,215,496 | 8/1980 | Wehr | 37/42 R X |
| 4,236,329 | 12/1980 | Hetrick | 37/42 R |

*Primary Examiner*—E. H. Eickholt

[57] ABSTRACT

The present invention includes a snow plow assembly adapted to be carried by a vehicle and including a snow plow mounting frame adapted to be fixedly secured to the vehicle frame, a plow blade, means for supporting the plow blade for vertical movement and a plow blade supporting member pivotally attached to the mounting frame for pivotal movement about a horizontal axis and for carrying a plow blade. Means are also provided for selectively causing vertical movement of the plow blade and including a linearly extensible member having a screw connected to the snow plow mounting frame, a threaded member threadably housing an opposite end of the screw, and an electric motor drivingly connected to the threaded member for selectively and alternatively driving the threaded member to cause relative rotation of said threaded member whereby the plow blade is moved vertically.

8 Claims, 4 Drawing Figures

SNOW PLOW ASSEMBLY INCLUDING LINEAR ACTUATOR

FIELD OF THE INVENTION

The present invention relates to a snow plow assembly of the type adapted to be mounted on a vehicle and more particularly to a snow plow assembly adapted to be readily attached to a conventional two-wheel drive light truck such as a pickup truck and employing an electric motor drive apparatus for causing elevation and lowering of the plow blade.

BACKGROUND PRIOR ART

Prior art snow plow assemblies adapted to be mounted on vehicles such as pickup trucks and other four wheel drive vehicles normally include a hydraulic ram for positioning the plow blade and a hydraulic fluid pressure source for selectively supplying hydraulic fluid to the hydraulic ram.

An example of a conventional snow plow assembly is illustrated in the Simi U.S. Pat. No. 3,307,275, issued Mar. 7, 1967 and assigned to the assignee of the present invention.

SUMMARY OF THE INVENTION

The snow plow assembly of the invention is intended to provide a less complicated and less expensive snow plow unit for attachment to a vehicle and to provide a snow plow assembly which does not require the employment of a relatively expensive hydraulic fluid pump and hydraulic cylinder along with the associated electrically actuated hydraulic valves. The snow plow assembly of the invention is also intended to permit the avoidance of heavy duty electrical apparatus in the vehicle which would otherwise be required if the snow plow was operated by hydraulic fluid mechanisms. Such heavy duty electrical apparatus normally include a heavy duty battery as well as a heavy duty alternator or generator. The snow plow assembly of the invention is also intended to be conveniently mounted on a vehicle.

Referring more particularly to the construction of the invention, it includes a snow plow assembly adapted to be carried by a vehicle having a frame and an electric power source. The snow plow assembly includes a snow plow mounting frame adapted to be fixedly secured to the vehicle frame, a plow blade, and means for supporting the plow blade for vertical movement, the supporting means including a plow blade supporting member having opposite ends, one end supporting the plow blade, and the other end being pivotally attached to the mounting frame for pivotal movement about a horizontal axis. The snow plow assembly also includes means for selectively causing vertical movement of the plow blade including a linearly extensible member including opposite ends, one end being supported by the snow plow mounting frame and the other end being connected to the forwardly extending end of the supporting member. The linearly extensible member includes a screw having one end pivotally connected to the snow plow mounting frame and a threaded member threadably engaging an opposite end of the screw. The means for causing vertical movement of the plow blade also includes an electric motor drivingly connected to the threaded member for selectively and alternatively driving the threaded member to cause relative rotation of the threaded member with respect to the screw, and means for connecting the threaded member to the other end of the supporting member whereby the plow blade is moved vertically in response to relative rotation of the threaded member with respect to the screw.

Various other features of the invention are set forth in the following description of the preferred embodiment, in the drawings, and in the claims.

Figure 4:
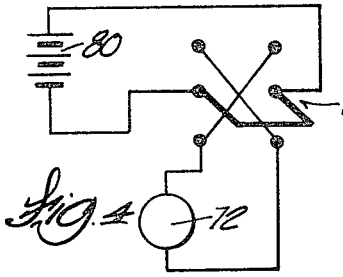
FIG. 4 is a schematic view of the means for selectively supplying electric power to the linear actuator assembly.

Before explaining at least one embodiment of the invention in detail, it is to be understood that the invention is not limited in its application to the details of construction and the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Figure 1:
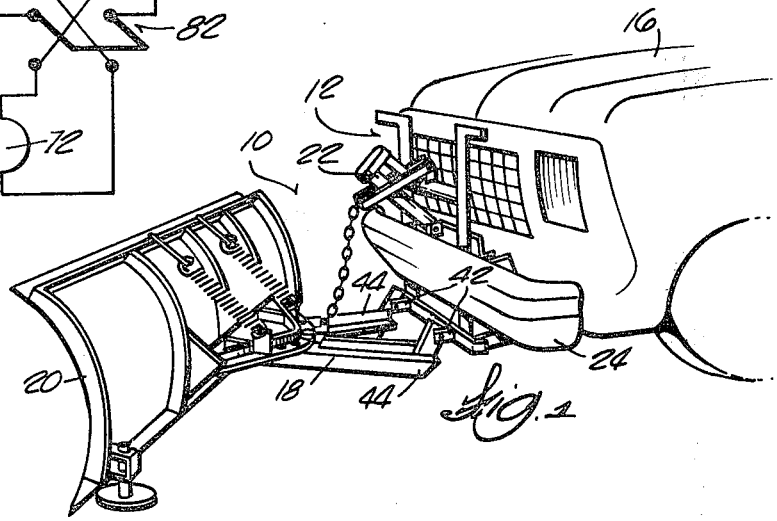
FIG. 1 is a perspective view of a snow plow assembly embodying the invention and shown as being mounted on a vehicle.
Figure 2:
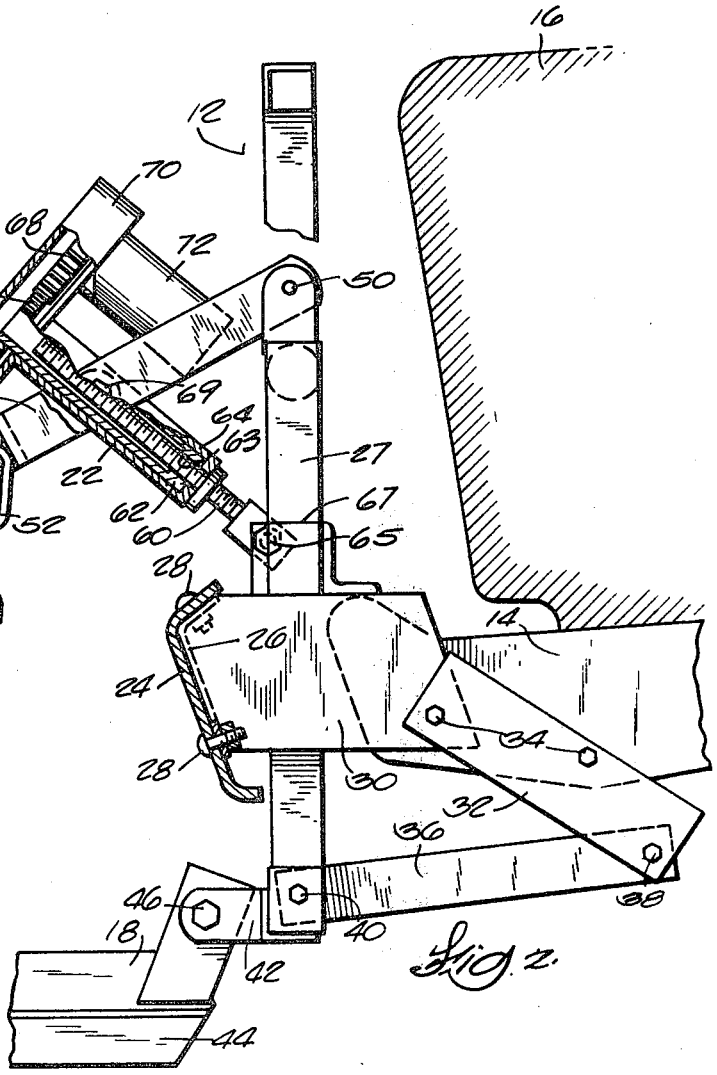
FIG. 2 is an enlarged view of the linear actuator assembly illustrated in FIG. 1 and with portions broken away.

With particular reference to FIGS. 1 and 2 of the drawings, a lift unit 10 is supported by a vertical mounting frame 12 suitably connected to the forward portion of the frame 14 of a vehicle 16. The vertical frame 12 is adapted to support a generally A-shaped plow blade supporting frame 18, the frame 18 having a forward end supporting the plow blade 20 and a rearward end pivotally connected to the vertical frame 12 for pivotal movement about a horizontal axis. Means are also provided for selectively and alternatively lifting and lowering the forward end of the plow blade supporting frame 18, that means comprising an electrically driven linear actuator 22 to be described more specifically hereinafter.

Referring more specifically to the embodiment illustrated in FIG. 2, the vertical frame 12 is illustrated as comprising a vertical rigid frame assembly adapted to be positioned rearwardly of the vehicle bumper 24 and to be supported by means fixedly connecting it to the vehicle bumper and the forward end of the vehicle frame 14. While the means for attaching the vertical rigid mounting frame 12 to the bumper 24 and to the forward end of the vehicle frame 14 can have various constructions, in the illustrated arrangement such means includes brackets 26 which are secured to the rearward surface of the bumper 24 by a plurality of bolts 28, the brackets 26 including rearwardly extending plate portions 30 welded to the two laterally spaced vertical angles 27 of the frame 12 and adapted to support the vertical frame. The means for attaching the vertical frame 12 to the vehicle frame 14 also includes diagonal plates 32 which are adapted to be bolted to the vehicle frame 14 by bolts 34 and to supporting bars 36 having their rearward ends fixedly secured to a rearward portion of the plates 32 by bolts 38. The forward ends of the supporting bars 36 are adapted to be secured by bolts 40 to the lower end of the vertical mounting frame 12.

Means are also provided to facilitate attachment of the rearward portion of the plow blade supporting frame 18 to the vertical frame 12 such that the plow blade mounting frame 18 is supported for pivotable movement about a horizontal axis. Such means includes a pair of laterally spaced mounting brackets 42 which extend forwardly from the lower portion of the vertical frame 12, the mounting brackets 42 being adapted to house the rearwardly extending arms 44 of the plow blade supporting frame 18 and to be connected thereto by bolts 46.

The means for selectively and alternatively causing vertical movement of the plow blade includes a lever arm or bracket 48 which is pivotably attached at its rearward end to the vertical frame 12 for pivotal movement about a horizontal pivot pin 50, and also includes a chain 52 which extends between the forward end of the lever arm 48 and the forward end of the plow blade supporting frame 18. The chain 52 is attached to the plow blade supporting frame 18 in such a manner that upward movement of the forward end of the lever arm 48 causes similar upward movement of the plow blade 20. Such movement of the lever arm 48 is generated by an electrically actuated linear actuator 22 having a lower end pivotally connected to the vertical frame assembly 12 and an upper end pivotably connected to the forwardly extending end of the lever arm 48 whereby linear extension of the linear actuator 22 causes upward movement of the forwardly extending end of the lever arm 48 and consequent upward movement of the forward end of the plow blade supporting frame 18.

While the linear actuator can have various conventional constructions, the linear actuator illustrated in the drawings is a commercially available linear actuator of the type produced by Saginaw Steering Gear Division of General Motors Corporation, Detroit, Michigan and identified as Part No. 7820511. The linear actuator 22 includes an elongated screw 60 threadably housed in a rotatable threaded member 62. In the illustrated construction the threaded member 62 comprises a cylinder having a threaded bore 63 in its lower end and threadably receiving the screw 60. The cylindrical rotatable threaded member 62 is rotatably supported in a cylindrical housing 64 and is restrained against linear movement with respect thereto. The rotatable threaded member 62 is also drivingly connected through a plurality of gears 66 and 68, mounted in a gear box 70, to an electric motor 72.

Figure 3:
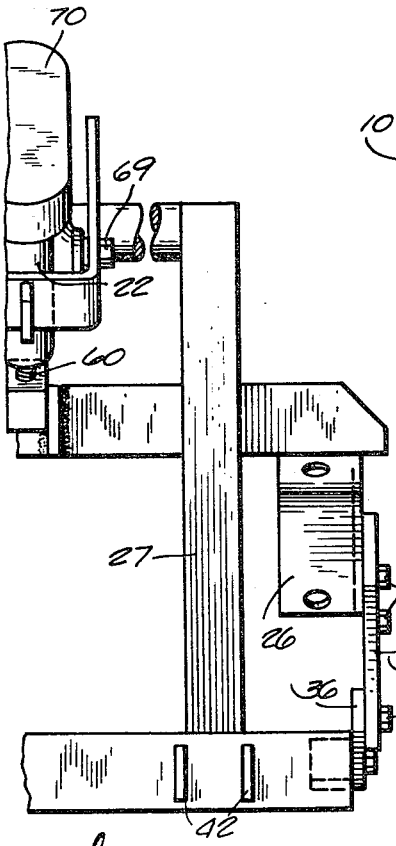
FIG. 3 is a partial end elevation view of the snow plow assembly shown FIG. 2.

The linear actuator 22 is mounted such that the free end or lower end of the elongated screw 60 is pivotably attached by a bolt 65 to a bracket 67 fixedly secured to the vertical mounting frame 12 for pivotal movement about a horizontal axis. The cylindrical housing 64 is provided with outwardly projecting trunnions or pivot pins 69 (FIG. 3) adapted to engage the lever arm 48 so as to be pivotably connected to the forward end of the forwardly extending lever arm 48. As will be readily appreciated by one skilled in the art, actuation of the electric motor 72 causes rotation of the threaded member 62 in such a manner as to cause linear extension of the elongated screw 60 with respect to the cylinder 64. Linear extension of the screw causes upward movement of the forwardly extending end of the lever arm 48 and consequent upward movement of the forward end of the plow blade mounting assembly 18 such that the plow blade 20 is lifted. If the electric motor 72 drives the threaded member in an opposite direction, the screw 60 is retracted with respect to the cylindrical housing 64 and the forward end of the lever arm 48 is lowered, thereby lowering the plow blade 20.

One of the advantages of the invention is that the linear actuator 22 is mounted such that the electric motor 72 and the gear box 70 are carried by the upwardly extending end of the cylinder 64. Mounting the electric motor in this manner elevates the electric motor 72 and protects it from potential damage by snow or moisture.

Another of the advantages of the invention is that employment of the linear actuator 22 as the means for effecting elevation of the plow blade, permits the use of the relatively simple arrangement illustrated in FIG. 4 for providing lifting power. The electric motor 72 is conveniently connected to a standard vehicle battery 80 through a conventional double pole, double throw type switch 82. Accordingly, the snow plow assembly described above can be easily installed without expensive modification of the vehicle's electrical system. Installation of the plow assembly is also facilitated because hydraulic pumps, fluid lines and hydraulic cylinders are avoided. As will be readily appreciated by those skilled in the art, elimination of such hydraulic apparatus also results in a substantial cost savings.

Various features of the invention are set forth in the following claims.

We claim:

1. A snow plow assembly adapted to be carried by a vehicle having a frame and an electric power source, the snow plow assembly comprising:

a snow plow mounting frame adapted to be fixedly secured to the vehicle frame, a plow blade, means for supporting the plow blade for vertical movement including a plow blade supporting member having opposite ends, one of said ends supporting said plow blade, the other of said supporting member opposite ends being pivotally attached to said frame for pivotal movement about a horizontal axis, and means for selectively causing vertical movement of said plow blade including a linearly extensible member including opposite ends, one of said ends being supported by said snow plow mounting frame and the other of said ends of said linearly extensible member being connected to said other of said ends of said supporting member and causing upward movement of said plow blade upon linear extension of said linearly extensible member and downward movement of said plow blade upon retraction of said linearly extensible member, said linearly extensible member including a screw and means for threadably engaging said screw, and means for selectively and alternatively causing relative rotation of said screw and said engaging means to thereby cause linear extension and retraction of said screw, one of said screw and said engaging means being connected to said mounting frame and the other of said screw and said engaging means being connected to said supporting member, and an electric motor for selectively causing relative rotation of said screw and said engaging means.

2. The snow plow assembly as set forth in claim 1 wherein said screw is pivotally connected to said snow plow mounting frame, and wherein said electric motor is carried by said engaging means.

3. The snow plow assembly as set forth in claim 1 wherein said means for selectively causing vertical movement of said plow blade includes a lever arm having opposite ends, one of said opposite ends being pivotally connected to said mounting frame and means for connecting the other of said ends of said lever arm to said other of said ends of said supporting member, and wherein said linearly extensible member includes a cylinder housing said means for threadably engaging said screw, said cylinder being connected to said other of said ends of said lever arm and said screw being connected to said mounting frame.

4. The snow plow assembly as set forth in claim 3 wherein said means for selectively causing vertical movement of said plow blade includes gear means operably connecting said electric motor and said means for threadably engaging said screw, said gear means and said electric motor being carried by said cylinder.

5. A snow plow assembly adapted to be carried by a vehicle having a frame and an electric power source, the snow plow assembly comprising a snow plow mounting frame adapted to be fixedly secured to the vehicle frame, a plow blade, means for supporting the plow blade for vertical movement including a plow blade supporting member having opposite ends, one of said ends supporting said plow blade, the other of said supporting member opposite ends being pivotally attached to said mounting frame for pivotal movement about a horizontal axis, and means for selectively causing vertical movement of said plow blade including a linearly extensible member having opposite ends, one of said ends being supported by said snow plow mounting frame and the other of said ends of said linearly extensible member being connected to said other of said ends of said supporting member, said linearly extensible member including a screw having one end pivotally connected to said snow plow mounting frame and a threaded member threadably housing an opposite end of said screw, and an electric motor drivingly connected to said threaded member for selectively and alternatively driving said threaded member to cause relative rotation of said threaded member with respect to said screw, said plow blade being moved vertically in response to relative rotation of said threaded member with respect to said screw.

6. The snow plow assembly as set forth in claim 5 wherein said screw is pivotally connected to said snow plow mounting frame, and wherein said electric motor is carried by said threaded member.

7. The snow plow assembly as set forth in claim 5 wherein said means for selectively causing vertical movement of said plow blade includes a lever arm having opposite ends, one of said opposite ends being pivotally connected to said snow plow mounting frame and means for connecting the other of said ends of said lever arm to said other of said ends of said supporting member, and wherein said linearly extensible member includes a cylinder housing said threaded member said cylinder being connected to said other of said ends of said lever arm and said screw being connected to said snow plow mounting frame.

8. The snow plow assembly as set forth in claim 7 wherein said means for selectively causing vertical movement of said plow blade includes gear means operably connecting said electric motor and said threaded member said gear means and said electric motor being carried by said cylinder.

* * * * *